United States Patent [19]

Lindström

[11] Patent Number: 4,565,508

[45] Date of Patent: Jan. 21, 1986

[54] DEVICE FOR CONTROLLING THE VOLUMETRIC CAPACITY OF A SCREW COMPRESSOR

[75] Inventor: Paul Lindström, Norrköping, Sweden

[73] Assignee: Stal Refrigeration AB, Norrköping, Sweden

[21] Appl. No.: 663,931

[22] Filed: Oct. 23, 1984

[30] Foreign Application Priority Data

Oct. 24, 1983 [SE] Sweden ..... 8305827

[51] Int. Cl.[4] ..... F01C 1/16

[52] U.S. Cl. ..... 418/201; 417/440

[58] Field of Search ..... 417/310, 440; 418/201

[56] References Cited

U.S. PATENT DOCUMENTS

| | | | |
|---|---|---|---|
| 3,874,828 | 4/1975 | Herschler et al. | 418/201 X |
| 3,936,239 | 2/1976 | Shaw | 418/201 X |
| 4,222,716 | 9/1980 | Shaw | 417/310 |

*Primary Examiner*—Richard E. Gluck

*Attorney, Agent, or Firm*—Watson, Cole, Grindle & Watson

[57] ABSTRACT

A device for controlling the volumetric capacity of a screw compressor having two rotors, which are in meshing engagement with each other, in a compression chamber enclosed in a housing, in which there is also arranged a bore in parallel with the rotors, the bore being connected to the compression chamber through a number of channels distributed axially in the bore, a plunger being arranged to be movably guided in the bore as volume control is effected. Depending on the position of the plunger in the bore, the number of the channels covered thereby varies. The plunger is hollow and has an opening at one end through which a rod fixed in the bore passes, the rod carrying a piston sealingly engaging the inside surface of the plunger. At its other end, the plunger is closed by an end wall. The position of the plunger in the bore is adjusted by the supply of a control medium, such as oil, which influences both sides of the end wall. Any volatile refrigerant, such as $R_{22}$ or $R_{12}$, dissolved in the control medium will not affect the capacity set by the device.

5 Claims, 5 Drawing Figures

DEVICE FOR CONTROLLING THE VOLUMETRIC CAPACITY OF A SCREW COMPRESSOR

BACKGROUND OF THE INVENTION

1. Technical Field

The present invention relates to a device for controlling the volumetric capacity of a screw compressor of the kind having a housing enclosing a compression chamber having an axis in which there are arranged two rotors which are in meshing engagement with each other, one end of the compression chamber being provided with a low-pressure end wall and the other end thereof being provided with a high-pressure end wall, a low-pressure port being arranged at the low-pressure end wall and a high-pressure port being arranged at the high-pressure end wall, a cylindrical, preferably rotary-symmetrical, bore being arranged with its longitudinal axis substantially parallel to the axis of the compression chamber and communicating with the compression chamber through a plurality of channels, disposed one after the other in the axial direction of the bore, a first end of the bore being connected to the low-pressure port, whereby a plunger is slidably arranged in the bore, the plunger closing a varying number of the noted channels, depending on its position in the bore.

2. Discussion of the Prior Art

A device of the above-mentioned kind is disclosed in U.S. Pat. No. 4,042,310. In the device described in this patent, the plunger directed towards the first end of the bore is put into connection with the low-pressure port by the supply of high pressure oil from the oil separator of the screw compressor on the high-pressure side thereof. Upon movement of the plunger in this direction, a helical spring is tensioned and endeavours to pull the plunger in a direction towards the other end of the bore (i.e., the high-pressure end of the screw compressor). The device as initially defined may be formed in a number of different ways. Thus, the plunger may be driven towards the low-pressure end of the bore by means of high pressure oil, thus compressing a helical spring which is acting to urge the plunger towards the other end of the bore. In both cases mentioned, oil is drained from the bore to the low-pressure side of the screw compressor. Unloading devices of the kind described operate satisfactorily in the case of screw compressors which are acting to compress gases such as $NH_3$ or air, which dissolve only to a very small extent in the lubricating oil which circulates in the screw compressor. When the screw compressor is used for compressing refrigerants such as $R_{22}$ ($CH\ ClF_2$) or $R_{12}$ ($CCl_2F_2$), however, these refrigerants are dissolved to a relatively large extent in the lubricating oil so that when a lubricating oil with a high content of dissolved refrigerant is supplied to the bore to displace the plunger, the reduction in pressure which takes place causes the refrigerant to come out of solution in gaseous form. Thus, the presence of the refrigerant in the oil gives rise to an uncontrolled volumetric increase in the bore, which displaces the plunger further towards the low-pressure side than was intended. The regulation of the volume capacity of a screw compressor under these circumstances is therefore imprecise and thus generally unsatisfactory.

OBJECT OF THE INVENTION

The object of the present invention is to provide an unloading device for a screw compressor which permits reliable regulation of the volumetric capacity of the screw compressor irrespective of whether the working medium being compressed is or is not soluble in the control medium used for unloading control.

SUMMARY OF THE INVENTION

According to the invention, a device of the kind described in the first paragraph of this specification is characterized in that the plunger is hollow and is provided with a bore, a hollow cylindrical mantle is slidably sealingly located within the bore, that part of the plunger which faces the first end of the bore being provided with an opening, through which a rod fixed stationarily in the bore is inserted, the rod holding a piston sealingly slidable against the inside of the plunger mantle, the part of the plunger which faces the opposite, other end, of the bore being provided with an end wall, which is closed, the position of the plunger in the bore being influenced by a control medium, capable of being supplied and discharged, through a first inlet and outlet through the rod and the piston connected to the interior of the plunger and influencing the inside of the end wall, as well as through a second inlet and outlet connected to the other end of the bore and influencing the outside of the end wall.

The primary advantage of a device in accordance with the invention is that the displacement of the plunger can be exactly controlled in both directions, since the same control medium is located on both sides of the other end wall of the plunger, and this ensures that the plunger is placed in the desired position.

In an advantageous embodiment of a device according to the invention, the channels are formed so that, seen in section parallel to the symmetry axis of the bore and perpendicular to a plane through the symmetry axis of a rotor and the symmetry axis of the bore, the channels appear to be elongated and directed substantially parallel to the pitch of the rotor.

For the loading/unloading control, different media may be used, but it is convenient to use the lubricating oil of the screw compressor, which can easily be supplied at the outlet pressure thereof and drained at the suction pressure thereof.

In a further advantageous embodiment of the invention, the end wall of the plunger is provided with a cylindrical, preferably circular cylindrical rod, extending in the longitudinal direction of the plunger, parallel to the symmetry axis of the plunger and running in a sealingly slidable manner through an opening in the housing of the screw compressor, directly influenced by the surrounding atmosphere.

Such a rod can be used both as a position indicator (to indicate the set degree of unloading) and as a restorer of the plunger to a position where all the channels between the inlet and the compression chamber are open, since a certain overpressure always prevails in the screw compressor.

BRIEF DESCRIPTION OF THE DRAWINGS

One embodiment of screw compressor unloading device in accordance with the invention will now be described by way of example, with reference to the accompanying drawings, wherein.

DESCRIPTION OF THE PREFERRED EMBODIMENT

Figure 1:
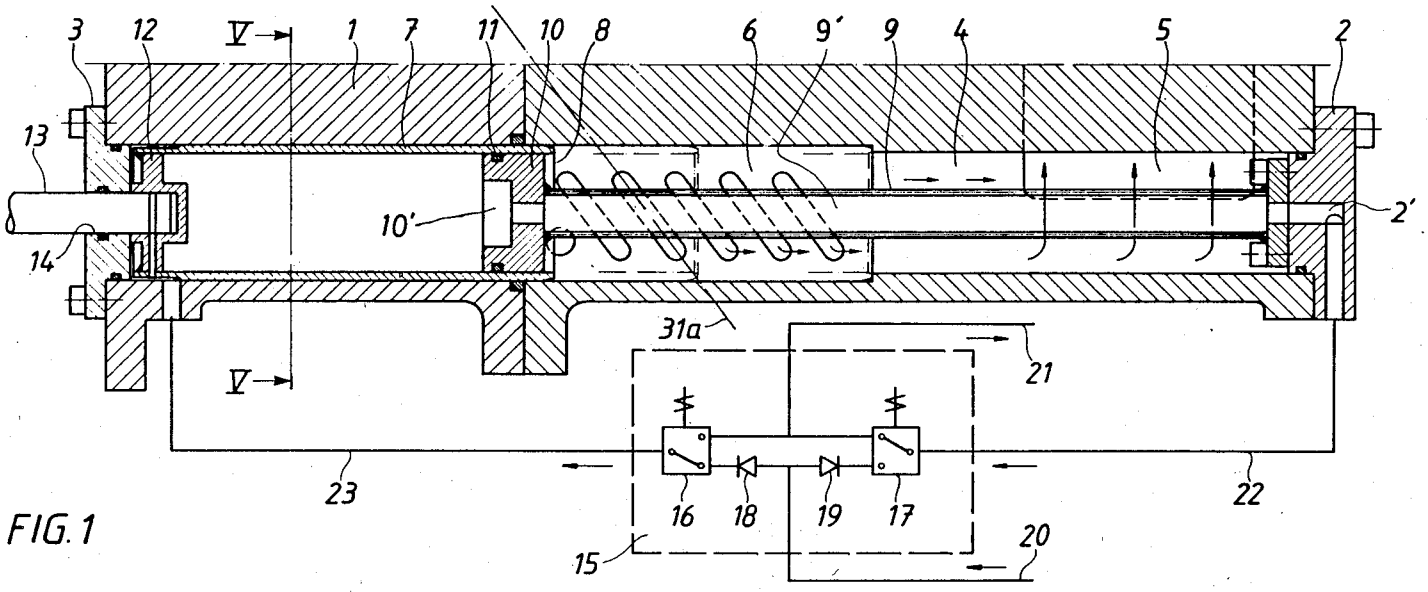
FIG. 1 shows a longitudinal section through the unloading device and a circuit diagram for a control medium.

FIG. 1 shows the unloading gear for a screw compressor. In FIG. 1, 1 designates part of the housing of the screw compressor, 2 and 3 designate, respectively, first and second covers (also respectively termed low and high pressure covers), 4 designates a bore of circular-cylindrical cross-section, 5 designates a return flow channel to suction pressure (also termed high pressure ports), 6 designates channels leading to a compression chamber 33 (see FIG. 5) (also termed high pressure ports). The channels 6 are angled, relative to the axis of the bore 4 so that each is directed substantially parallel to the pitch of the rotor opposite them in the compression chamber 33. The pitch is shown by the chain line 31*a* in FIG. 1.

Running inside the bore 4 is a plunger, with a mantle 7 and an opening 8 through which passes a hollow rod 9 fixed to the cover 2. The rod 9 has a channel 9′ extending therethrough and it carries on its free end (located between the high pressure ports 6 and the high pressure cover 3) a piston 10 which is dimensioned to slide within the mantle 7 and, by means of an annular gasket 11, to seal against the inside of the mantle 7. The plunger is also provided with a closed end wall 12, to which is fixed a rod 13 extending coaxially with the plunger outside the housing 1. The rod 13 is sealed in sliding manner in an opening 14 in the cover 3.

A control unit 15 for the unloading gear described above is also shown in FIG. 1 and comprises two three-way valves 16 and 17 and two nonreturn valves 18, 19. A conduit 20 extends from that part of an oil storage reservoir of the screw compressor, where a high pressure prevails, to the control unit 15, and from there a conduit 21 extends to the suction side of the screw compressor. From the control unit 15 a conduit 22 extends to a channel 2′ extending through the cover 2 and further through a channel 9′ in the rod 9 and a channel 10′ in the piston 10 to the interior of the plunger, so that oil flow through the conduit 22 can influence the inner side of the end wall 12. From the control unit 15, a conduit 23 also extends to the high-pressure end of the bore 4, so that oil flow through the conduit 23 can influence the outer side of the end wall 12.

METHOD OF OPERATION

Figure 2:
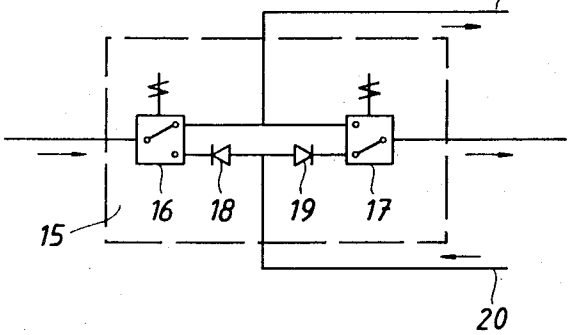
FIGS. 2 to 4 show the circuit diagram of FIG. 1 in other possible set positions.
Figure 3:
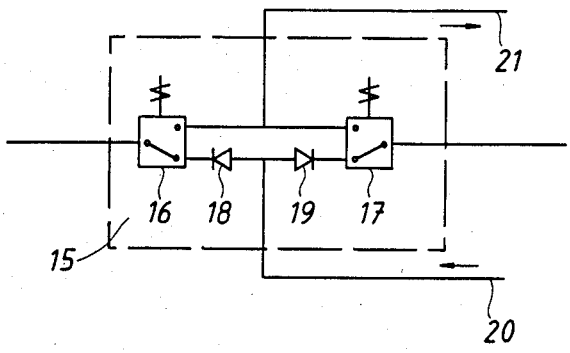

The device operates as follows:

When there is a demand for increased capacity, the valve 16 is positioned so that high pressure oil flows through the conduit 23 to influence the outside of the end wall 12, and displace the plunger so that the channels 6 are covered successively in the proper order. This successively reduces the possibility of returning compressed gas via the return channel 5 to the suction side of the screw compressor. Since the valve 17 is positioned so that the conduit 22 communicates with the conduit 21, oil from the area between the end wall 12, the piston 10 and the inside of the mantle can flow through the channel 10′ in the piston 10, the channel 9′ in the rod 9, the channel 2′ in the cover 2 and the conduit 22 back to the suction side. Now, if it is desired to unload the compressor, i.e., reduce its capacity somewhat, the valves 16 and 17 are reset (either manually or automatically) to the positions shown in FIG. 2, and the plunger is made to move in the opposite direction, the channels 6 now opening sequentially in the proper order. If it is desired to hold the screw compressor in a set condition of partial load, the valves 16, 17 are set in the positions shown in FIG. 3, when the plunger has attained the desired position of unloading. With the valve settings shown in FIG. 3, the plunger cannot move further in the bore since the oil volumes on both sides of the end wall 12 are fixed by means of the nonreturn valves 18, 19.

Figure 4:
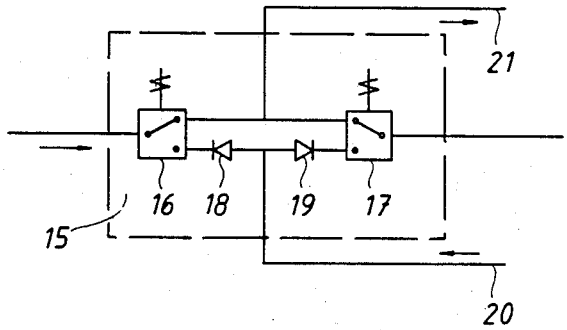

When the screw compressor has been stopped, the plunger should be moved to the position for minimum capacity, i.e., with all the channels 6 open, since otherwise an excessively high torque could arise upon restart of the screw compressor. When the screw compressor is stopped, the valves 16, 17 are set as shown in FIG. 4. The oil pressure existing at the time the compressor is stopped acts from the right over the entire area of the end wall 12 whereas from the left it acts only over the annular area of the end wall 12 which surrounds the opening 14, the opening 14 being subjected to atmospheric pressure. Thus the plunger is driven towards its minimum position and the oil is drained off through the conduits 23 and 21.

Figure 5:
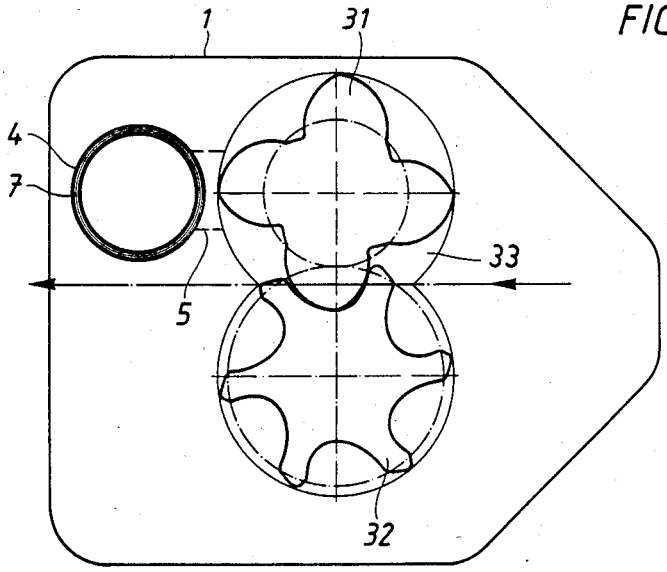
FIG. 5 shows a section on the line V—V in FIG. 1 through a screw compressor with an unloading device according to the invention.

FIG. 5 shows a section of the housing 1 taken on the line V—V in FIG. 1. From this section it can be seen how the bore 4 with the mantle 7 and the return channel 5 are located in relation to the intermeshing compressor rotors 31, 32 in the compression chamber 33 which has the cross-sectional shape of an "8".

What is claimed is:

1. In a screw compressor which includes a housing that defines an elongated compression chamber, a cylindrical bore which extends in parallel with said elongated compression chamber, said cylindrical bore having a first end and a second end, a low-pressure port which extends from said cylindrical bore near said first end thereof to said compression chamber, and a plurality of high-pressure ports which extend from said cylindrical bore between said low-pressure port and the second end thereof to said compression chamber; a low-pressure cover which covers the first end of said cylindrical bore; a high-pressure cover which covers the second end of said cylindrical bore; two interengaging rotors located in said elongated compression chamber; and a plunger which is slidingly positioned within said cylindrical bore and, depending on its location within said cylindrical bore, is capable of closing a varying number of said high pressure ports, the improvement wherein said plunger includes a hollow cylindrical mantle which seals against said cylindrical bore and is slidingly movable therealong, said mantle having an open first end which faces the first end of said cylindrical bore and a second end which faces the second end of said cylindrical bore; and a closed end wall which sealingly encloses the second end of said mantle, said closed end wall having an inner side which faces the first end of said cylindrical bore and an outer side which faces the second end of said cylindrical bore, a hollow rod stationarily mounted on said low-pressure cover to extend along said cylindrical bore toward said high-pressure cover, said hollow rod having a free end located between said plurality of high-pressure ports and said high-pressure cover, a piston attached to the free end of said hollow rod, said piston being sealingly slidable within the mantle of said plunger, said piston having a channel therethrough which communicates between the interior of said hollow rod and the interior of said mantle, said low-pressure cover includes a channel therethrough which communicates with the interior of said hollow rod and, together with the interior of said hollow rod and the channel in said piston, enables control fluid to pass into and out of the mantle of said plunger, and a duct which communicates with said cylindrical bore to enable control fluid to pass into and out of the cylindrical bore between the high-pressure cover at the second end thereof and the closed end wall of said plunger, the relative pressures of the control fluid acting against the inner and outer sides of the closed end wall of said plunger determining the location of said plunger along said cylindrical bore and thus the number of high-pressure ports closed by the mantle thereof.

2. The screw compressor as defined in claim 1, wherein said cylindrical bore has a circular cross section.

3. The screw compressor as defined in claim 2, wherein said cylindrical bore defines an axis and wherein said high-pressure ports are helically elongated with respect to said axis.

4. The screw compressor as defined in claim 1, wherein said high-pressure cover includes an opening therethrough and wherein said plunger includes a cylindrical rod which sealingly extends from the outer side of said closed end wall through said opening in said high-pressure cover.

5. The screw compressor as defined in claim 1, wherein said control fluid is oil.

* * * * *